US005224234A

United States Patent [19]

Aesenault et al.

[11] Patent Number: 5,224,234

[45] Date of Patent: Jul. 6, 1993

[54] TOOTHBRUSH WITH REPLACEABLE BRISTLES

[76] Inventors: Jeffrey L. Arsenault, P.O. Box 904, Arden, N.C. 28704; Charles R. Sigmon, 432 Bethel Hill Rd., Clover, S.C. 29710

[21] Appl. No.: 687,262

[22] Filed: Apr. 18, 1991

Related U.S. Application Data

[63] Continuation-in-part of Ser. No. 468,063, Jan. 22, 1990, abandoned.

[51] Int. Cl.[5] ..... A46B 9/04

[52] U.S. Cl. ..... 15/167.1; 15/176.1; 15/176.6

[58] Field of Search ..... 132/308, 310; 15/167.1-167.3, 143 R, 159 R, 159 A, 160, 106, 186-188, DIG. 5, 176.1, 176.6, 172, 146, 176.5

[56] References Cited

U.S. PATENT DOCUMENTS

| | | | |
|---|---|---|---|
| 959,574 | 5/1910 | Moore | 15/176.1 |
| 1,251,250 | 12/1917 | Libby | 15/176.1 X |
| 1,407,214 | 2/1922 | Osborn | 15/176 |
| 1,415,898 | 5/1922 | Rost | 15/176.1 |
| 1,567,507 | 12/1925 | Howard | 15/176.1 |
| 1,625,537 | 4/1927 | Gullickson | 15/176.1 |
| 1,667,464 | 4/1928 | Wagner | 15/231 X |
| 1,682,325 | 8/1928 | D'Amico et al. | 15/176.1 |
| 1,797,946 | 3/1931 | Eichel | 15/188 |
| 1,908,510 | 5/1933 | Dodson | 15/176.4 |
| 1,944,797 | 1/1934 | McElwain | 15/176.4 |
| 1,963,389 | 6/1934 | Vardeman | 15/188 |
| 1,968,303 | 7/1934 | McMath | 15/167.1 |
| 2,056,447 | 10/1936 | Fell | 15/167.1 |
| 2,638,614 | 5/1953 | Anderson | 15/176.6 X |
| 2,648,082 | 8/1953 | Teetsel | 15/176.1 X |
| 2,668,973 | 2/1954 | Glaza et al. | 15/167.1 |
| 2,706,825 | 4/1955 | Blakeman | 15/176.4 |
| 2,772,433 | 12/1956 | Brunda | 15/176.1 |
| 3,081,783 | 3/1963 | Miller | 15/176.1 X |
| 3,128,487 | 4/1964 | Vallis | 15/176.1 |
| 3,271,805 | 9/1966 | Sawyer | 15/176.1 |
| 3,553,759 | 9/1968 | Kramer et al. | 15/188 |
| 4,104,759 | 8/1978 | Odhner | 15/176.6 |
| 4,362,174 | 12/1982 | Baker et al. | 15/176.1 X |
| 4,472,853 | 9/1984 | Rauch | 15/167.1 |
| 4,543,679 | 10/1985 | Rosofsky et al. | 15/104.92 |
| 4,890,349 | 1/1990 | Nitzsche | 15/167.1 |
| 4,890,732 | 1/1990 | Shackelford | 132/310 X |

FOREIGN PATENT DOCUMENTS

| | | | |
|---|---|---|---|
| 2546712 | 4/1977 | Fed. Rep. of Germany | 15/176.4 |
| 101839 | 6/1941 | U.S.S.R. | 15/176.1 |
| 24478 | of 1909 | United Kingdom | 15/176.1 |
| 23807 | of 1911 | United Kingdom | 15/176.1 |
| 216355 | 5/1924 | United Kingdom | 15/167.1 |
| 1405845 | 9/1975 | United Kingdom | 15/209 R |

*Primary Examiner*—Harvey C. Hornsby
*Assistant Examiner*—Charles Cooley
*Attorney, Agent, or Firm*—Ralph H. Dougherty

[57] ABSTRACT

A toothbrush with replaceable disposable bristles. A two unit toothbrush has a base member including a handle and a receptacle for a detachable bristle assembly unit which mates with the base member by insertion into the receptacle in which it is retained by a positive retaining member, such as a mating nib and groove. The bristle assembly is disposable and replaceable.

5 Claims, 5 Drawing Sheets

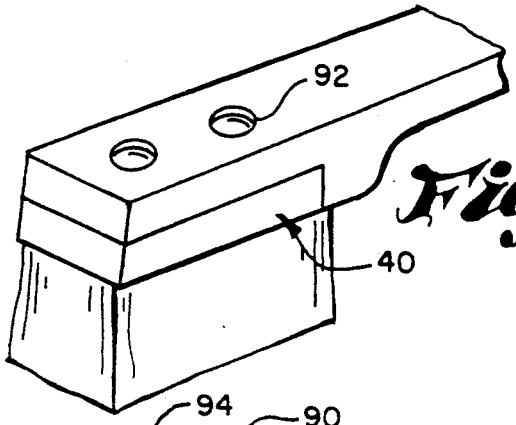
Fig.25
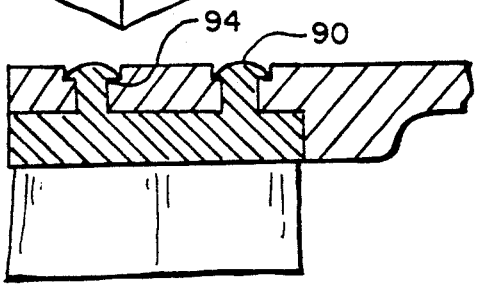
Fig.26
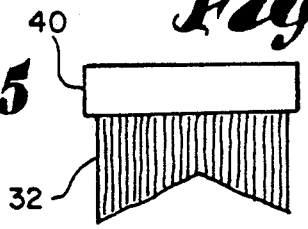
Fig.27
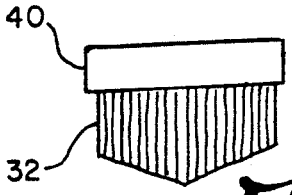
Fig.28
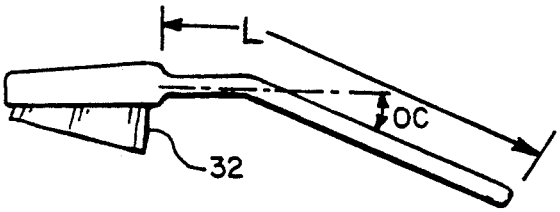
Fig.29
Fig.30
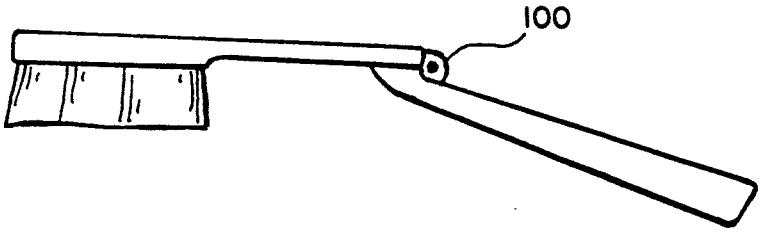

TOOTHBRUSH WITH REPLACEABLE BRISTLES

CROSS REFERENCE TO RELATED APPLICATIONS

This application is a continuation-in-part of our copending U.S. patent application Ser. No. 07/468,063 filed Jan. 22, 1990, now abandoned.

FIELD OF THE INVENTION

The present invention relates to the field of hygienic cleaning apparatus, particularly apparatus which comes into contact with the human body. The invention is an improvement in oral hygiene apparatus, and more particularly an improvement in toothbrushes having replaceable bristles.

BACKGROUND OF THE INVENTION

A toothbrush with replaceable toothbrush bristles is a cost-effective means to promote improved oral hygiene. It has been suggested that a user replacing his toothbrush at least every two weeks on a regular basis, and more often in situations such as after surgery or while undergoing chemotherapy, will result in greatly reduced germ accumulation and transmission from a bacteria-encrusted toothbrush bristle. It is believed that after a short period of usage, the bristles of a toothbrush become worn and softened, thus losing their cleaning effectiveness. A replaceable toothbrush bristle provides a cost-effective alternative by allowing the user to replace only the cleaning bristles at a fraction of the price of an entire one-piece conventional style toothbrush. By reusing and occasionally disinfecting the bristle retainer, as well as replacing the bristles on a regular basis, an effective tooth cleansing method will be provided, along with promoting healthier gums.

Glaza et al. U.S. Pat. No. 2,668,973 teaches a channel-style toothbrush handle with an insertable brushhead, the end of the brushhead being adapted for engaging and shoving another brushhead through the channel and out of the way for disposal. Glaza employs a leaf spring retainer which is not integral with the base member, but is attached thereto and requires a longitudinal slot for accommodating the spring. Applicants, in their preferred embodiment, employ a nib within a recess integral with the base member. Note that Glaza's brushhead is not reversible as the two ends are substantially different being adapted for mating with another brushhead. Gullickson U.S. Pat. No. 1,625,537 teaches replacing only the central line of bristles, the outer rows of bristles being irreplaceable. Gullickson's toothbrush is intended only for the purpose of easy cleaning of the brush. He requires two retainers, a transverse pin and a U-shaped clip, either of which may be used without the other. Nonetheless, the retaining mechanism is a safety hazard in either case, as it provides an additional foreign body of small size, to be placed into the mouth, which, if it became dislodged (which appears probable) or accidentally removed, could easily become lodged in a throat, causing choking. Glaza's device is extremely unsafe in that it has many pinch points, sharp corners and edges which could catch a tongue or any portion of the mouth or lip, including the leaf spring, which is extremely dangerous. Applicants' device is much safer, as it avoids the pinch points and sharp edges of the Glaza or Gullickson devices.

The invented toothbrush has both replaceable and disposable bristles. Through regular use of this style toothbrush and regular periodic replacement of the bristles, bacteria accumulation will be reduced, and plaque build-up will be minimized.

The regular use of this style toothbrush and replacement of bristles will decrease the risk of germ transmission that contributes to cavities and gum disease, and will promote a healthy mouth and a healthy body.

SUMMARY OF THE INVENTION

The invention comprehends a two unit toothbrush, consisting of a base member including a handle and a holder for a detachable bristle assembly unit, and a bristle assembly unit which mates with the base member. A positive bristle assembly retaining means such as a snap lock or a mating nib and groove is provided to secure the bristle unit to the base in each of the embodiments of the invention. The bristle assembly, which is disposable and replaceable, may have any of several bristle length configurations.

The invented toothbrush has separable mated parts, specifically a one-piece bristle assembly and a bristle assembly receptacle. The bristle assembly has a bristle holder symmetric about a longitudinal axis, first and second ends normal to the longitudinal axis, a lower surface with embedded bristles, and side walls depending perpendicularly upward from the lower surface. The upper surface of the bristle assembly has two lower sliding surfaces depending from the side walls parallel to the lower surface, two oppositely inclined sliding surfaces extending upwardly from the lower sliding surfaces and away from the longitudinal axis, and a curved top sliding surface fixed between the inclined sliding surfaces with at least one transverse groove spaced from the first end in the curved top surface. The bristle assembly receptacle has a longitudinal axis, a handle at one end and means for receiving and retaining the bristle assembly at the other end. The receptacle has oppositely inclined side walls, a curved top wall fixed between the oppositely inclined sidewalls, a flat end wall normal to the longitudinal axis, a nib transverse to the longitudinal axis which depends from the underside of the curved top wall adjacent to, but spaced from, the flat end wall, and parallel coplanar surfaces extending from a bottom portion of each inclined side wall and away from the longitudinal axis. The bristle assembly and receptacle provide five surfaces of sliding contact upon mating of the parts.

OBJECTS OF THE INVENTION

The principal object of the invention is to provide an improved toothbrush with replaceable bristles.

A further object of this invention is to provide an improved toothbrush with disposable bristles.

Another object of the invention is to provide an improved toothbrush, the regular use of which, along with regular replacement of bristles, will reduce bacteria accumulation in the toothbrush and in the user's mouth.

Another object of the invention is to provide an improved toothbrush, the regular use of which will minimize plaque build-up on the user's teeth.

Another object of the invention is to provide an improved toothbrush, the regular use of which will decrease the risk of germ transmission that contributes to development of cavities and gum disease.

Another object of the invention is to provide an improved toothbrush, the regular use of which will promote a healthy mouth and a healthy body.

It is another object of the invention to provide a tooth brush assembly which can be assembled without touching the bristles.

It is another object of the invention to provide a tooth brush assembly which has multiple bristle arrangements available, which will allow the user to change to a different bristle configuration at any time.

BRIEF DESCRIPTION OF THE DRAWINGS

The foregoing and other objects will become more readily apparent by referring to the following detailed description and the appended drawings in which:

FIG. 25 is an isometric view of an alternative tooth brush assembly utilizing a pin engaging means.

FIG. 26 is an longitudinal section through the assembly of FIG. 25.

FIG. 27 is a side view of an alternative bristle arrangement for any of the tooth brush assembly embodiments.

FIG. 28 is a side view of another alternative bristle arrangement for any of the tooth brush assembly embodiments.

FIG. 29 is a side view of an alternative handle arrangement for any of the tooth brush assembly embodiments shown.

FIG. 30 is a side view of another alternative handle arrangement for any of the tooth brush assembly embodiments shown.

DETAILED DESCRIPTION

Figure 1:
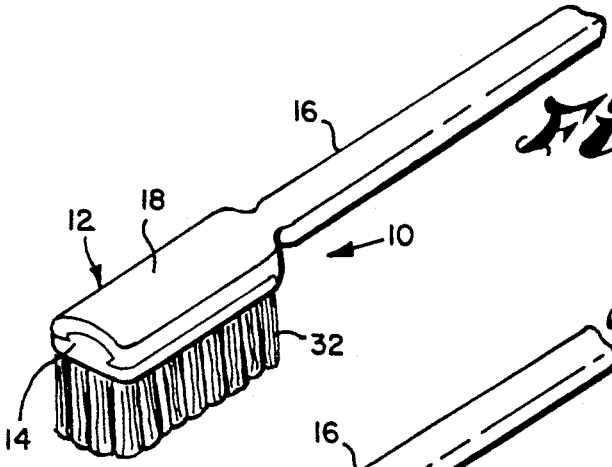
FIG. 1 is an isometric view of the invented tooth brush assembly.
Figure 2:
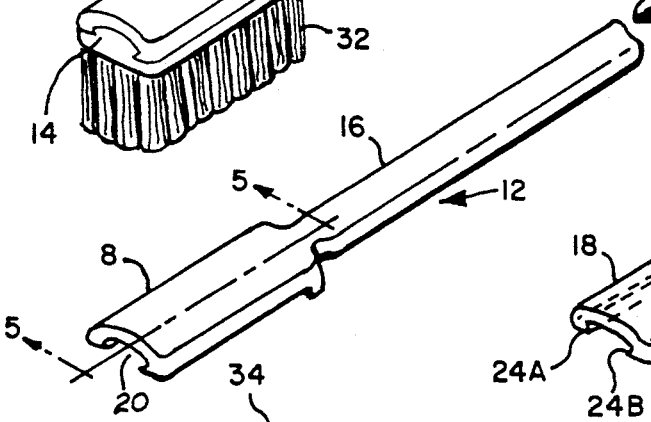
FIG. 2 is an isometric view of the handle of the invented tooth brush assembly of FIG. 1.
Figure 6:
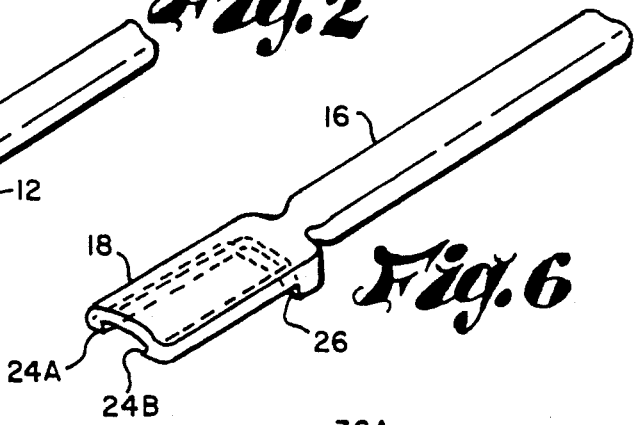
FIG. 6 is an isometric view of the handle of the invented tooth brush assembly showing details of the underside with hidden lines.
Figure 9:
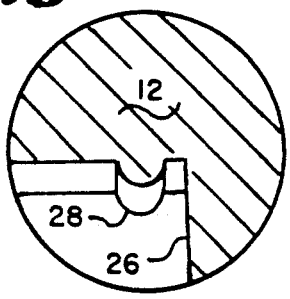
FIG. 9 is an enlarged horizontal section view of a portion of the handle of the invention shown in FIG. 8.

Referring now to the drawings, and particularly to FIG. 1, the invented toothbrush apparatus 10 includes two separable units, a base member or holder 12 and a removable bristle assembly unit 14. Base member 12 includes an elongated handle 16 connected to a bristle assembly receiving portion or retainer 18, which has a recess 20 on its underside for receiving bristle assembly unit 14 therein. The recess is defined by a preferably curved top surface 22 with inclined or beveled side surfaces 24A, 24B and a bristle assembly stop or back surface 26 generally normal to the longitudinal axis of the base member. A downward protrusion, or nib 28, integral with the base member 12, is situated within the recess 20, preferably near the stop surface 26, as best shown in FIG. 9.

Figure 3:
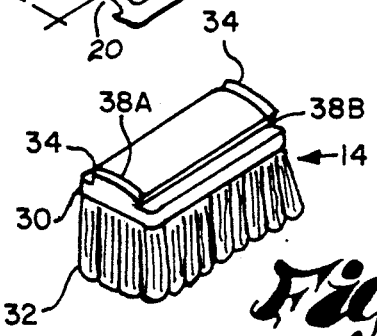
FIG. 3 is an isometric view of the bristle assembly of the invented tooth brush assembly.
Figure 7:
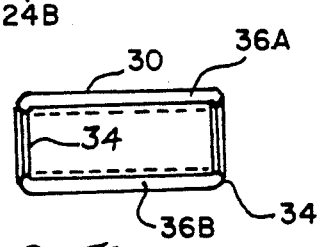
FIG. 7 is a top view of the bristle assembly of FIG. 3.
Figure 4:
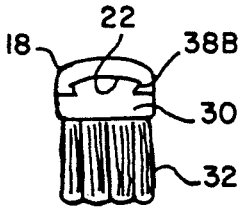
FIG. 4 is a left end view of the invented tooth brush assembly of FIG. 1.
Figure 5:
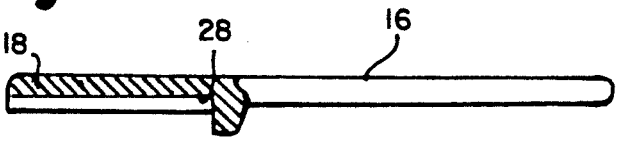
FIG. 5 is a partially sectioned view of the handle of FIG. 2, the section taken along line 5—5 of FIG. 2.
Figure 8:
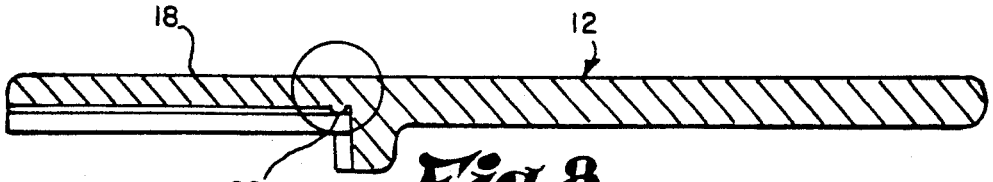
FIG. 8 is a horizontal section view of the handle of FIG. 2.

A replaceable and disposable toothbrush bristle assembly unit 14, as seen in FIG. 3, includes a bristle holder 30 into which bristles 32 are affixed by any desired means, the bristles extending downwardly from the holder 30. Retaining grooves 34 are provided on the preferably domed top of the bristle holder 30 to engage the retaining nib 28 of the base member.

Bevelled edges 38A, 38B on each side of the top of holder 30 and upstanding from coplanar surfaces 36A, 36B are adapted for engagement with mating beveled surfaces 24A, 24B of the base member 12, which provides sliding action for engaging the holder 30 with the base unit 12, and forming a dove-tail joint. The angle of the bevels and the mating of coplanar surfaces 36A, 36B with the corresponding coplanar surfaces on the underside of the base member 12 insures that no side to side or rocking motion is created in the bristle holder 30 relative to the base when in use. This prevents damage to the teeth while the apparatus is being used.

The replaceable toothbrush bristle assembly unit is safe, comfortable, and it is easily manufactured as it does not require complicated molds.

As shown in FIG. 1, the replaceable toothbrush bristle assembly is in its operational, fully mated relationship. Mating is accomplished by simply holding the base member by the handle 16 and sliding the replaceable bristle assembly unit 14 into the bristle retainer 18. Unobstructed sliding action occurs until the leading end of holder 30 contacts the retaining nib 28. Upon exerting a slight force on the exposed end of the replaceable bristle unit, a snap and locking action occurs as the retaining nib 28 seats itself within the retaining groove 34 of the replaceable bristle holder 30, whereupon the two units are fully mated and ready for use. The locking mechanism between the two units can be engaged and disengaged without touching the bristles.

To remove the replaceable bristles, they are grasped on each side with the thumb and forefinger and exertion of a slight pulling action in the reverse direction of insertion results in withdrawal of the bristle holder, which may then be disposed of, and a new unit inserted.

Preferably, the replaceable bristle holder is provided with two retaining grooves 34, one at each end. This allows insertion of the bristle assembly unit 14 from either end, which avoids the necessity for the user to determine the proper orientation. The snap and lock concept secures the two units and prevents unintentional separation while brushing. In addition, when fully mated, the assembly resists independent sliding motion which could tend to cause disengagement or which could damage teeth.

The closely mating surfaces restricts movement in any direction between the two units. Sliding, twisting or rattling of the mated parts could create a safety hazard in an oral application.

The mating surfaces of each unit preferably have a zero clearance tolerance between them, with the exception that the dome surface of the bristle retainer has a 0.002" clearance allowance. Water seepage between the two units is thus inhibited, and therefore the establishment of a bacteria breeding ground is avoided.

The nib is integral with the base member. The mating of the coplanar surfaces along with the dovetail joint provide stability of the brush holder assembly unit. The parallel nib receiving grooves provide reversibility, and the very close tolerances prevent foreign matter from entering the spaces between the faying surfaces.

A coating of natural or synthetic rubber, or tetrafluoroethylene may be provided on the two mating surfaces of the units, which establishes a gasket-like seal.

ALTERNATIVE EMBODIMENTS

Figure 11:
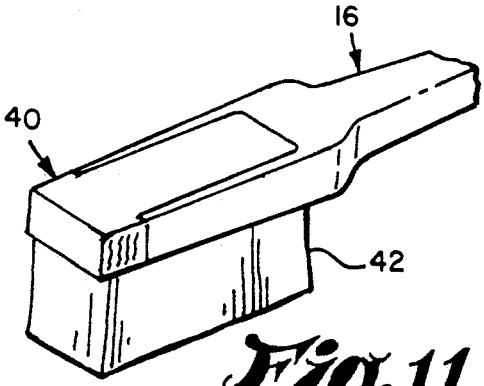
FIG. 11 is an isometric view of an alternative tooth brush assembly embodiment.
Figure 13:
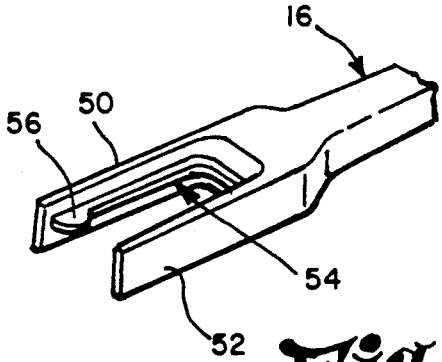
FIG. 13 is an isometric view of a portion of the handle and bristle assembly retaining arms in accordance with the tooth brush assembly embodiment of FIG. 11.
Figure 12:
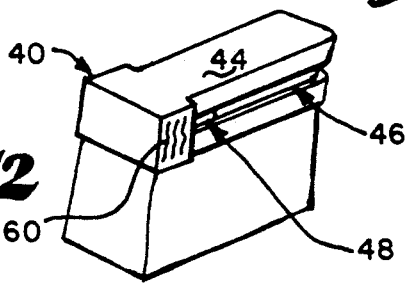
FIG. 12 is an isometric view of the bristle assembly insert for the tooth brush assembly of FIG. 11.

The alternative embodiment shown in FIGS. 11, 12, and 13, includes a bristle assembly with a brush head 40 having downwardly depending bristles 42 embedded in head 40. The sides of the head are partially recessed to form a T-shape when viewed from the top. On each side of the narrower portion 44 of the head, a groove 46 is provided with a deeper portion 48 which forms a locking recess. As seen in FIG. 13, the handle has arms 50 and 52 extending therefrom, each arm having an internal ridge 54 adapted for engagement with the groove 46 in the brush head. A pair of opposed locking nibs 56 are provided on the ridges 54 for engagement with the locking recesses 48 in the brush head.

Figure 14:
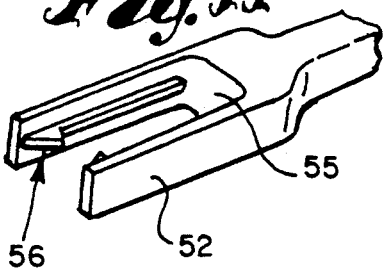
FIG. 14 is an isometric view of alternative bristle head retaining arms to those of FIG. 13.

Two alternatives are shown in FIG. 14, wherein there is no ridge at the closed end of the handle and the locking nib is angular rather than rounded. In this configuration, the handle is twisted to spread or open the arms 50, 52 slightly when the brush head is removed for replacement. Vertical ridges or striations 60 can be provided on the end of the brush head to enable fingers to obtain a purchase when removing the brush head.

Figure 15:
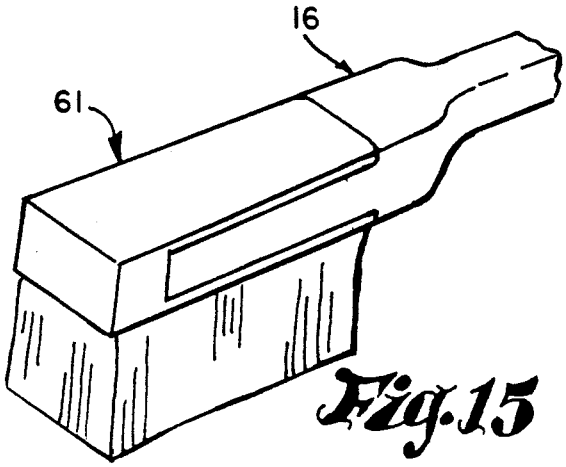
FIG. 15 is an isometric view of another alternative embodiment of the invented tooth brush assembly.
Figure 17:
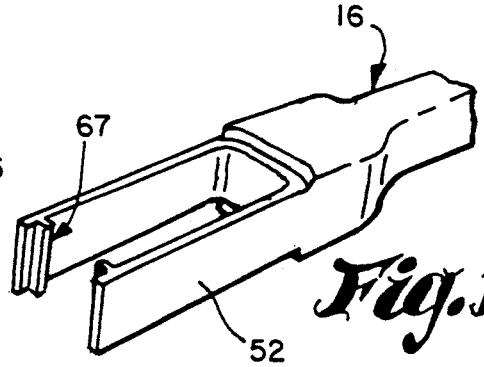
FIG. 17 is an isometric view of the handle and integral bristle assembly retaining arms of FIG. 15.
Figure 16:
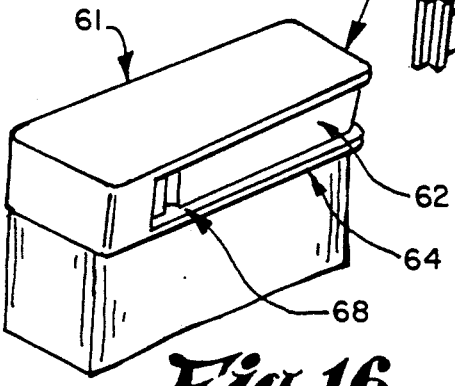
FIG. 16 is an isometric view of the bristle assembly of FIG. 15.
Figure 18:
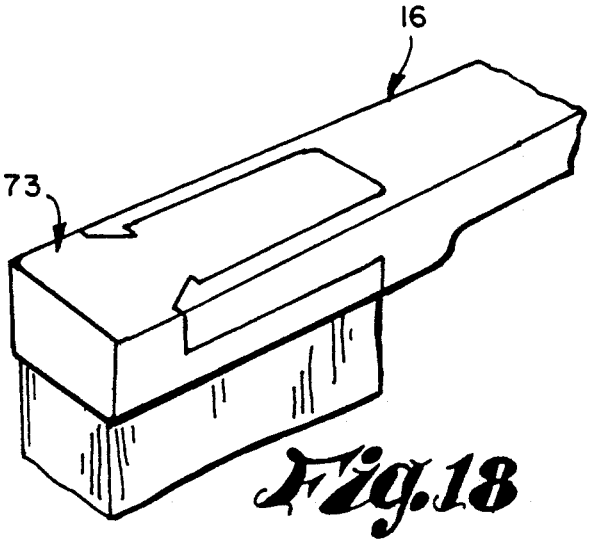
FIG. 18 is an isometric view of another alternative tooth brush assembly embodiment.
Figure 20:
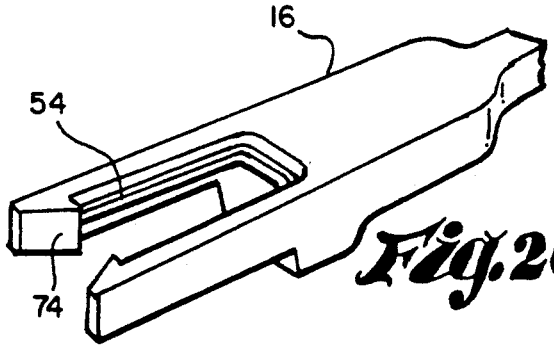
FIG. 20 is an isometric view of the handle and bristle assembly retaining arms of the tooth brush assembly of FIG. 18.
Figure 19:
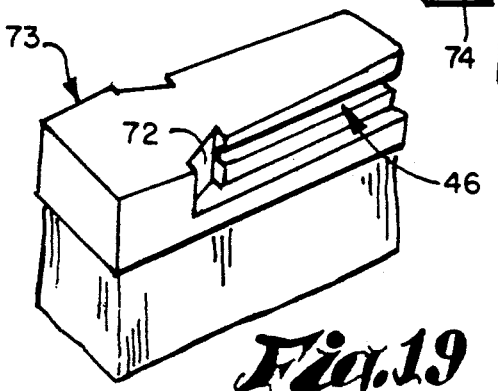
FIG. 19 is an isometric view of the bristle assembly of the alternative tooth brush assembly of FIG. 18.

The embodiment of FIGS. 15, 16, and 17, includes a brush head with a recess 62 formed in both side 64 and end 66 for receiving the arms of the toothbrush handle or base. Vertical locking nibs on the arms engage a mating recess in the brush head.

Figure 21:
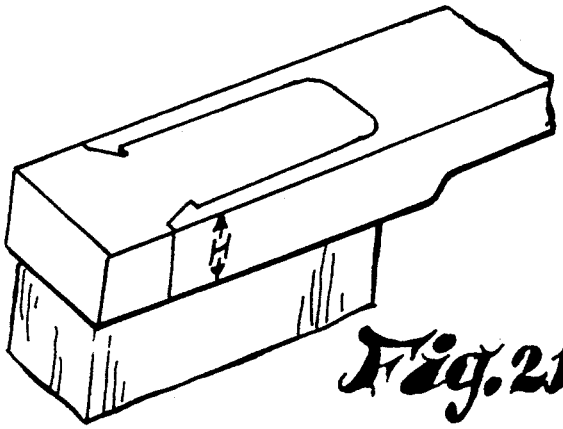
FIG. 21 is an isometric view of an alternative to the tooth brush assembly of FIG. 18.

The alternative embodiment shown in FIG. 18 through 21 includes a greater recessed area 72 in the sides of the brush head for engagement by retaining members 74 on the ends of the arms. As shown in FIG. 21, the retaining members can be the full height of the brush head, or, as in FIG. 18, can be less than the full height. The ridge and groove arrangement prevents twisting or turning of the brush head when in use.

Figure 22:
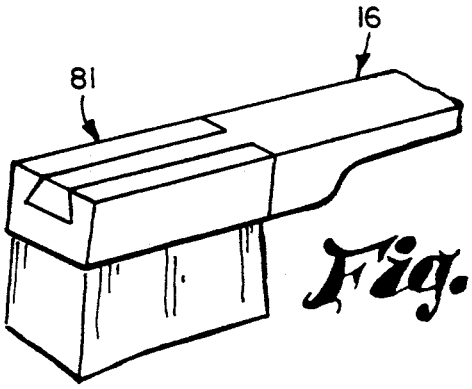
FIG. 22 is an isometric view of another alternative embodiment of the invented tooth brush assembly.
Figure 24:
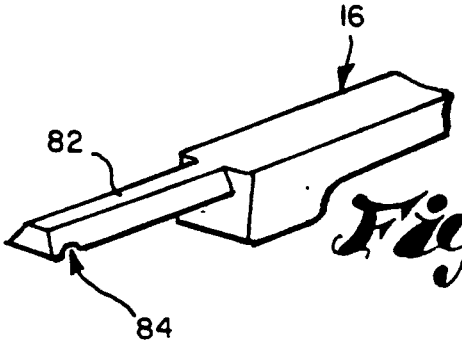
FIG. 24 is an isometric view of the handle and associated bristle head retainer of the tooth brush assembly embodiment of FIG. 22.
Figure 23:
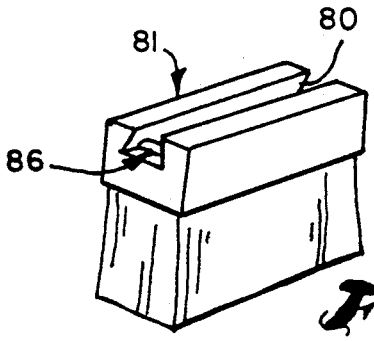
FIG. 23 is an isometric view of the bristle assembly of the tooth brush assembly embodiment of FIG. 22.

The alternative embodiment of FIGS. 22 through 24 includes a dove-tailed groove 80 in the brush head, with a mating protrusion 82 extending from the handle. The protrusion 82 has a lower nib 84 for mating with a horizontal recess 86 in the bottom on the dove-tail groove of the brush head. By providing such a recess 86 at both ends of the brush head, the orientation of the brush head is immaterial, as it can be inserted from either end, and still be held firmly in place when in use.

The embodiment of FIGS. 25 and 26 includes a brush head with snap and lock mushroom head pins 90 extending upwardly from the top of the brush head insert. Vertically oriented receiving holes 92 are provided in the handle with a slight recess 94 at the upper end of the hole for holding the mushroom heads tightly in place.

Figure 10:
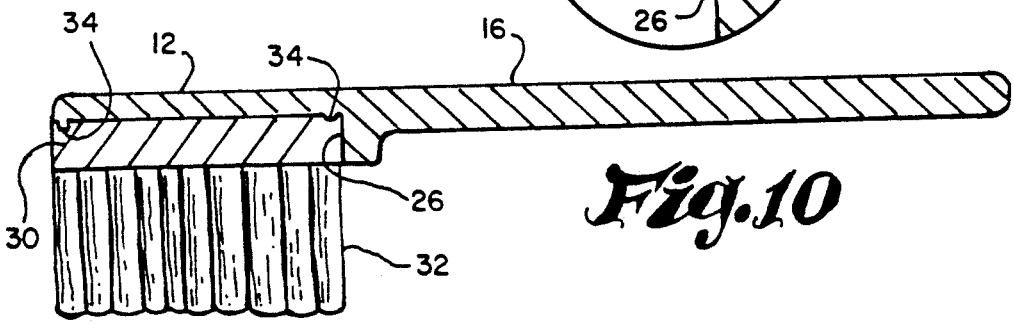
FIG. 10 is a horizontal section view of the invented tooth brush assembly of FIG. 1.

The bristles can be provided in several bristle arrangements, such as straight, tapered, or angled arrangements. All bristles can be substantially the same length as shown in FIG. 10, or the length of the bristles at the end away from the handle can be shortest with the remaining bristles being progressively longer, with the longest bristles nearest the handle portion, as shown in FIG. 29. Alternatively, the bristles can be long in the center and progressively shorter toward both sidewalls of the bristle assembly as in FIG. 28, or short in the middle and longer on both ends as in FIG. 27. The entire toothbrush, including inserts, can be provided in both child's and adult sizes.

It is advantageous for the handle of the toothbrush to be bent at a 4 to 20 degree angle as shown in FIG. 29, the apex of such angle preferably being located about one-third to one-half the length L of the handle from the bristle assembly receptacle. The preferred angle is 4 to 8 degrees. As shown in FIG. 30, the handle may pivot about a hinge 100 in the vicinity of the apex of the angle, which allows the entire assembly to be foldable to fit a small package.

SUMMARY OF THE ACHIEVEMENT OF THE OBJECTS OF THE INVENTION

From the foregoing, it is readily apparent that we have invented an improved toothbrush with replaceable and disposable bristles, the regular use of which, along with regular replacement of bristles, will reduce bacteria accumulation in the toothbrush and in the user's mouth, will minimize plaque build-up on the user's teeth, will decrease the risk of germ transmission that contributes to development of cavities and gum disease, and will promote a healthy mouth and a healthy body.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A toothbrush having separable mated parts comprising:

a one-piece bristle assembly having;

a bristle holder symmetric about a longitudinal axis, a first end normal to the longitudinal axis, a second end normal to the longitudinal axis, a lower surface with embedded bristles, side walls depending perpendicularly upward from said lower surface, and an upper surface having;

two lower sliding surfaces depending from said side walls parallel to said lower surface, two oppositely inclined sliding surfaces extending upwardly from said lower sliding surfaces and away from said longitudinal axis, and a curved top sliding surface fixed between said inclined sliding surfaces with at least one transverse groove spaced from said first end in said curved top surface, and;

a bristle assembly receptacle having;

a longitudinal axis, a handle at one end thereof and bristle assembly receiving means at the other end, which includes oppositely inclined side walls, a curved top wall fixed between said oppositely inclined sidewalls, a flat end wall normal to the longitudinal axis, a nib transverse to the longitudinal axis, said nib depending from the underside of said curved top wall adjacent to, but spaced from, said flat end wall, and parallel coplanar surfaces extending from a bottom portion of each inclined side wall and away from the longitudinal axis;

wherein said bristle assembly and said receptacle provide five surfaces of sliding contact upon mating of the parts.

2. A toothbrush according to claim 1, wherein said curved top sliding surface of said bristle assembly has at least one transverse groove spaced from said second end.

3. A toothbrush according to claim 1, wherein the bristles are longest in the center along the longitudinal axis and progressively shorter toward the side walls of said bristle assembly.

4. A toothbrush according to claim 1, wherein the handle of the toothbrush is displaced at an angle to the bristle assembly receptacle, so that the bristle assembly and handle are in different planes.

5. A toothbrush according to claim 4, wherein the angle has an apex located from one-third to one-half the length of the handle from the bristle assembly receptacle.

* * * * *